United States Patent [19]

Heideman et al.

[11] Patent Number: 4,571,870

[45] **Date of Patent: * Feb. 25, 1986**

[54] QUICK RELEASE MOUNT FOR FIREARM AIMING DEVICE

[75] Inventors: Robert J. Heideman, Westland; Jerry B. Holden, Livonia; Richard W. Crain, Canton, all of Mich.

[73] Assignee: Hydra Systems International, Inc., Bridgeport, Conn.

[ * ] Notice: The portion of the term of this patent subsequent to Sep. 10, 2002 has been disclaimed.

[21] Appl. No.: 544,541

[22] Filed: Oct. 24, 1983

[51] Int. Cl.[4] ..... F41G 1/34

[52] U.S. Cl. ..... 42/1 A; 42/1 R

[58] Field of Search ..... 42/1 A, 1 ST, 1 R, 86, 42/75 A, 15; 362/110, 111

[56] References Cited

U.S. PATENT DOCUMENTS

| | | | |
|---|---|---|---|
| 408,860 | 8/1889 | Stubbs | 126/285 R |
| 922,077 | 5/1909 | Bennett | 33/256 |
| 1,083,288 | 1/1914 | Lowe | 42/1 ST |
| 1,835,576 | 12/1931 | Sparr | 42/1 ST |
| 2,447,892 | 8/1948 | Baliff | 362/111 |
| 2,452,145 | 10/1948 | Pike | 42/1 ST |
| 2,743,525 | 5/1956 | Leupold | 42/1 ST |
| 3,633,285 | 9/1970 | Sensney | 42/1 A |
| 3,867,764 | 2/1975 | Dunmeu et al. | 42/1 A |
| 4,026,054 | 5/1977 | Snyder | 42/1 A |
| 4,044,486 | 8/1977 | Van Holten | 42/1 ST |
| 4,079,534 | 3/1978 | Snyder | 42/1 A |
| 4,114,302 | 9/1978 | Litman | 42/1 ST |
| 4,152,754 | 5/1979 | deFilippis et al. | 42/1 A |
| 4,161,076 | 7/1979 | Snyder | 42/1 A |
| 4,168,588 | 9/1979 | Snyder | 42/1 A |
| 4,212,109 | 7/1980 | Snyder | 42/1 A |
| 4,291,478 | 9/1981 | Lough | 42/1 A |
| 4,313,272 | 2/1982 | Matthews | 42/1 A |
| 4,313,273 | 2/1982 | Matthews et al. | 42/1 A |

*Primary Examiner*—Charles T. Jordan

*Attorney, Agent, or Firm*—Kramer and Brufsky

[57] ABSTRACT

A quick release mount for securing an aiming device such as a laser on the barrel of a rifle includes a forward and rear mount shiftably mounted on a base plate to which the aiming device is permanently secured. The forward mount includes a spring-loaded slide member slideably mounted on the base plate and a split ring secured to the slide member which is sleeved over the barrel and biased into sliding engagement with a stop member on the barrel, such as a flame arrester. The rear mount includes a body member provided with slots and a locking mechanism for releasably receiving a shoe which is permanently secured to the barrel. The front mount includes an elevational adjustment while the rear mount includes a windage adjustment mechanism.

28 Claims, 6 Drawing Figures

QUICK RELEASE MOUNT FOR FIREARM AIMING DEVICE

TECHNICAL FIELD

The present invention broadly relates to apparatus for mounting sighting and aiming devices on firearms, and deals more particularly with an assembly for releaseably mounting a laser sighting device or the like on the barrel of a rifle.

BACKGROUND ART

Mechanisms for mounting telescopes and similar aiming devices of firearms are well-developed in the art. Known mounting arrangements normally require a tool or similar instrument to mount or dismount the device from the rifle barrel. Releaseable mounting arrangements have been provided in the past which comprise two portions; a first portion which is permanently secured to the rifle and a second portion secured to the telescope. The two portions of the mount are interconnected by slides and/or screws. However, even these mounting arrangements also require a tool or implement to manipulate the screws and require considerable time to manipulate or adjust.

The problem of designing a quick release mount is further complicated by the windage and elevational adjustment mechanisms that are normally provided on such mounts. These adjustment mechanisms often interfere with or complicate the release mechanisms, and in any event, the calibration of the windage and elevation adjustments is altered when the telescope is removed from the rifle.

In connection with military weapons, the need for increasing firearm aiming accuracy has resulted in the development of laser and infra-red aiming devices. Lasers mounted on the barrel of a rifle, for example, projects a beam which forms a spot as far away as several hundred yards on a target. Assuming that the trajectory of the laser beam is calibrated to that of the bullet, the bullet should strike the target spot.

The diverse nature of combat conditions dictates the need for a laser mount which is versatile, highly accurate and allows quick mounting and dismounting of the laser in the field without the need for special tools or instruments. Moreover, it would be desirable to provide a quick release laser mount having windage and elevational adjustment mechanisms which are unaffected by mounting and dismounting of the laser.

SUMMARY OF THE INVENTION

According to the present invention, a quick release mounting assembly for mounting a laser or similar aiming device on the barrel of a firearm includes a base plate upon which the laser or other aiming device is permanently secured as well as forward and rear mounts which releaseably connect the base plate to the barrel. The forward mount includes a spring loaded slide member slideably mounted on the forward end of the base plate and includes a split mounting ring adapted to be sleeved over the rifle barrel, into engagement with a stop or flame arrester which is permanently secured to the barrel. The rear mount includes a body member and a pair of locking levers which receive and lockably engage a shoe such as a bayonet mount or the like which is permanently affixed to the barrel. Either the front or rear mount includes an elevational adjustment while the other mount is provided with a windage adjustment. The components of the front and rear mount are spring loaded so as to maintain them in constant relationship with each other thus precluding unwanted variation in windage or elevation adjustment when the laser is dismounted and subsequently remounted on the firearm.

It is therefore a primary object of the present invention to provide apparatus for mounting an aiming device such as a laser on the barrel of a rifle in a manner which allows the device to be quickly disconnected from the rifle without need for tools or special instruments.

Another object of the invention is to provide a quick release mount as described above which includes adjustments for elevation and windage which are unaffected by dismounting and subsequent remounting of the device.

Another object of the invention is to provide a quick release mount as described above which maintains the components of the mount in constant relationship to each other so as to preclude arbitrary and unpredictable changes in the windage or elevation adjustment due to slight movement of the components relative to each other.

A still further object of the invention is to provide a quick release mount as described above which is adapted to be used with existing military weapons of the type having a flame arrester and a bayonet mount.

These, and further objects of the invention will be made clear or will become apparent during the course of the following description of a preferred embodiment of the present invention.

BRIEF DESCRIPTION OF THE DRAWINGS

In the drawings, which form an integral part of the specification and are to be read in conjunction therewith, and in which like reference numerals are employed to designate identical components in the various views.

DETAILED DESCRIPTION OF THE INVENTION

Figure 1:
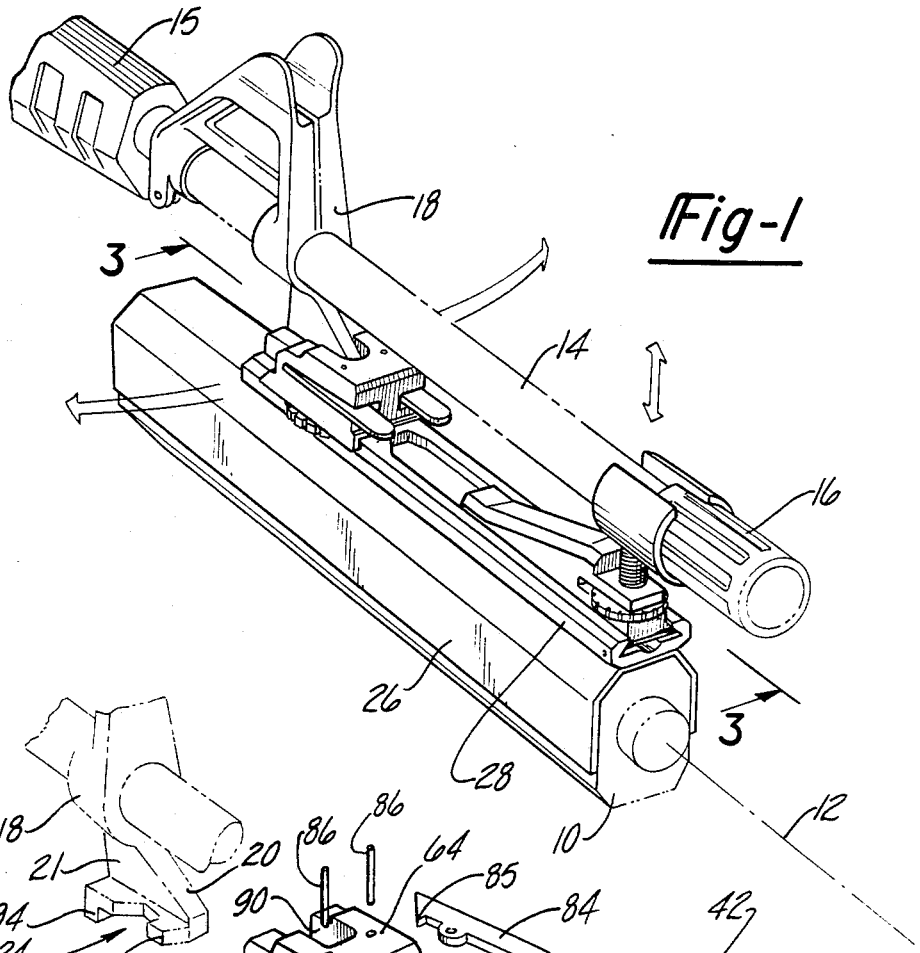
FIG. 1 is a prespective view of a rifle barrel having a laser aiming device mounted thereon using the quick release mount of the present invention.
Figure 2:
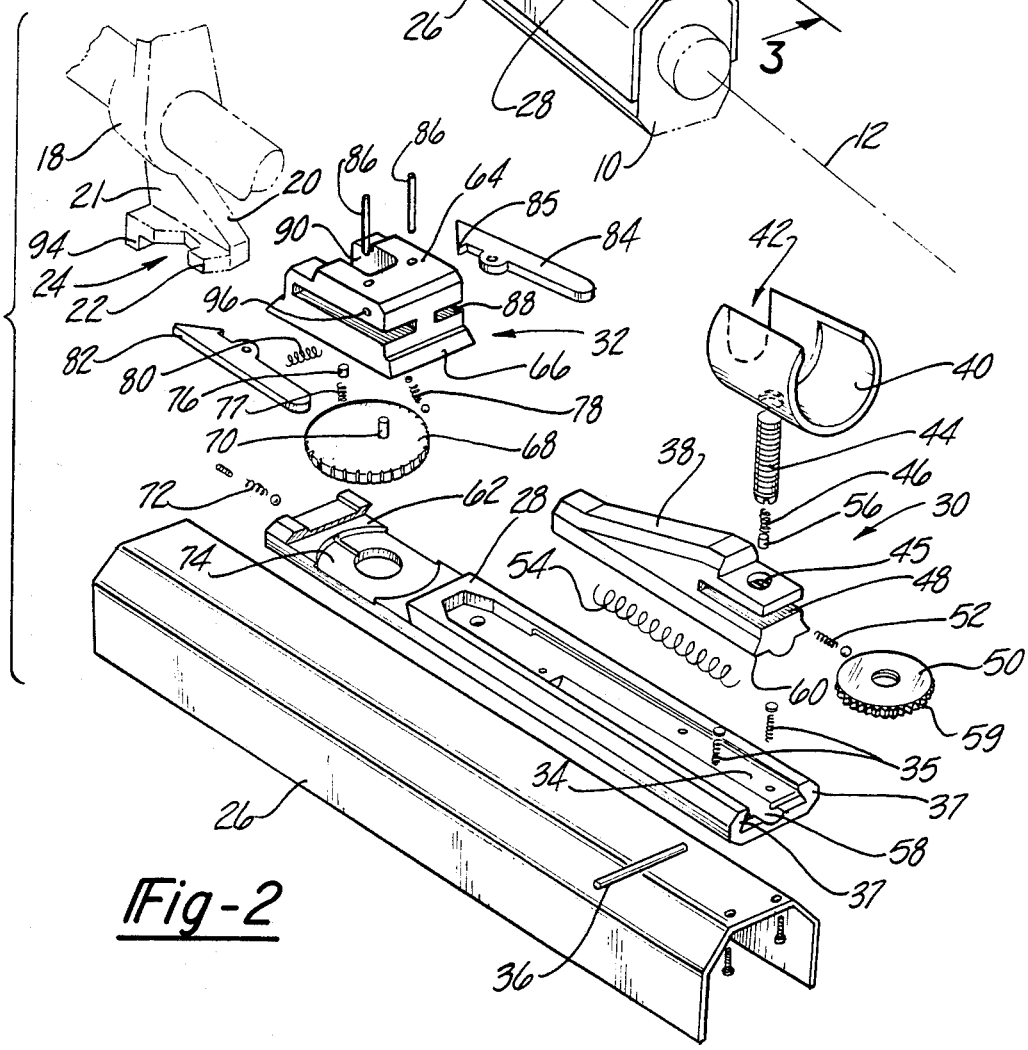
FIG. 2 is an exploded, prespective view of the quick release mount shown in FIG. 1.
Figures 3, 4, 5, 6:
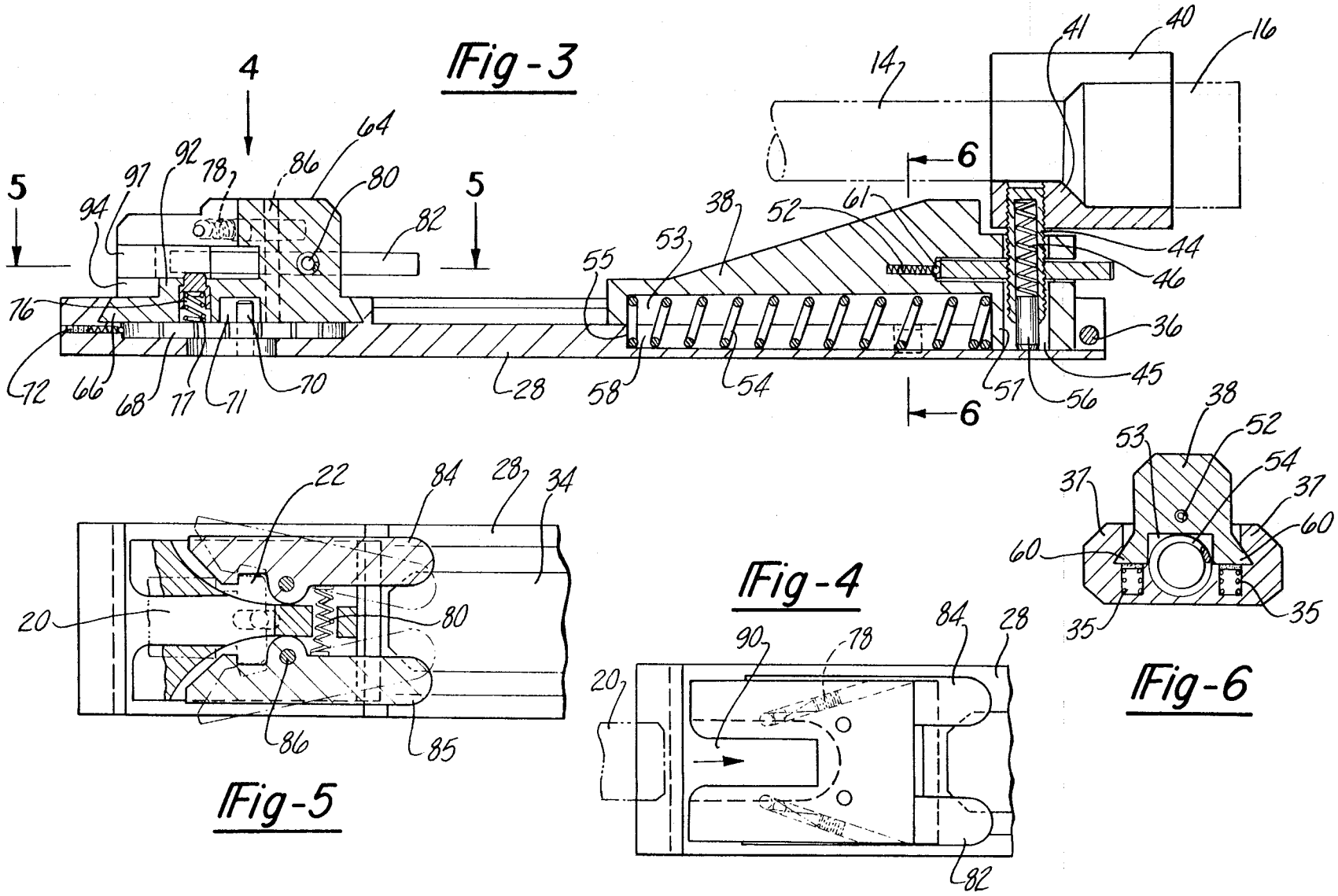
FIG. 3 is a sectional view taken along the line 3—3 in FIG. 1.
FIG. 4 is a plan view of the rear mount looking in the direction of the arrow 4 in FIG. 3.
FIG. 5 is a sectional view taken along the line 5—5 of FIG. 3.
FIG. 6 is a sectional view taken along the line 6—6 in FIG. 3.

Referring now to the drawings, the present invention is broadly concerned with a quick release mount for releaseably mounting a laser aiming device 10 on the barrel 14 of a firearm, such as rifle 15. The rifle 15 as shown in the drawings, is the well known M-16 type however, as will become apparent hereinafter, the quick release mount of the present invention is well adapted for use with various other types of firearms as well.

The rifle 15 includes a cylindrically shaped flame arrester 16 on the outer end thereof which possesses a diameter larger than that of the barrel 14. A bayonet mount 18 is secured to the barrel 14, rearward of the flame arrester 16 and includes a downwardly depending shoe 20. Shoe 20 includes a downward projection 21 provided with a pair of lateral shoulders 22 near the bottom thereof, each of the shoulders 22 being provided with a cutout or notch 24 therein. A transversely extending wall 94 depends downwardly beneath, and at the rear end of shoulders 22. The bayonet mount 18 described above is of conventional design and is adapted to normally releaseably mount a bayonet (not shown) on the barrel 14.

The quick release mount of the present invention broadly includes a longitudinally extending base plate 28 suspended beneath the barrel 14 by means of a forward mount 30 and a rear mount 32. The laser 10, which is of conventional design and forms no part of the present invention, projects a laser beam along a line 12 to form a spot of light on the target toward which the rifle 15 is aimed. As will be discussed later in more detail the forward mount 30 includes means for adjusting the elevation of the laser beam relative to the longitudinal axis of the barrel 14, while the rear mount 32 includes means for adjusting the horizontal alignment, i.e. windage, of the laser beam relative to longitudinal axis of barrel 14. The laser 10 is secured by any suitable means within a U-shaped tubular bracket 26 which in turn is mounted to the bottom of the base plate 28 with screws or the like. The laser 10 is therefore fixedly secured to the bottom of base plate 28.

The base plate 28, as well as the other components of the mount are preferably constructed from strong, light-weight material such as aluminum. Base plate 28 includes a longitudinally extending, slot-like depression 34 in the upper face thereof within which there is slideably disposed a slide member 38. Slide member 38 is confined for sliding movement in slot 34 by means of laterally extending gibs 60 on slide member 38 which are received within ways 37 defined in opposite sides of slot 34. A compression spring 54 is captured between a semi-circular, longitudinally extending slot 58 in base plate 28 and a cavity 53 in the bottom face of slide member 38. One end of the spring 54 engages an end wall 55 in the slot 58, while the other end thereof bears against an end wall 57 in slide member 38. Thus, spring 54 normally biases the slide member 38 forwardly. A pin 36 secured in the base plate 28 extends across the end of slot 34 and engages the slide member 38 at its forward most position of travel, thus forming a stop for retaining the slide member 38 within the slot 34. The slide member 38 is biased upwardly away from base plate 28 such that the gibs 60 bear tightly against ways 37 by means of pair of springs 35 which are received within depressions within the slot 34 and bear against the bottom of slide member 38.

The slide member 38 is releaseably coupled with the barrel 14 by means of a cylindrically shaped, split ring 40 which is sleeved over the barrel 14. Ring 40 includes an internal shoulder 41 which matingly engages and bears against the flamer arrester 16. The ring 40 includes a continuous, longitudinal slot 42 on the upper side thereof which is of sufficient width to allow passage therethrough of the barrel 14. Mounting ring 40 is mounted on the slide member 38 by means of an adjustment screw 44 which extends through a vertical aperture 45 in slide member 38, the upper end of adjustment screw 44 being threadably received within a threaded aperture in mounting ring 40. Adjustment screw 44 extends through and is secured to a thumbwheel 50 which is received within a slot 48 in slide member 38. The outer periphery of thumbwheel 50 is provided with regularly spaced teeth 59. A ball 61 is loaded into engagement with the teeth 59 by a spring 52 received within a passageway within slide member 38. The force of spring 52 is sufficient to prevent inadvertent turning of thumbwheel 59 but may be easily overcome by application of concentrated finger force to the thumbwheel 59 when it is desired to adjust the elevation of the forward mount 30. Adjustment screw 44 is hollow and includes a cylindrical slide 56 which is biased into sliding engagement with the bottom of slot 34 by means of a spring 46. Spring 46 bears against the top of adjustment screw 44 thereby biasing the latter upwardly such that the upper surface of thumbwheel 50 bears tightly against the upper surface of slot 48.

The rear mount 32 includes a body 64 provided with gibs 66 which are received within ways defining a cutout 62 in the rear of base plate 28, thereby mounting body 64 for transverse sliding movement at the rear of base plate 28. The rear end of body 64 is provided with a vertical slot 90 which is adapted to receive the projection 21 of shoe 20. Body 64 also includes a pair of horizontal slots in the rear thereof which slideably receive shoulders 22 of shoe 20 therein. Longitudinally extending, horizontal slots 88 on opposite sides of body 64 are aligned with slots 97 and have pivotally mounted therewithin by means of pins 86 a pair of corresponding locking levers 82 and 84. Locking levers 82, 84 are provided with hook-like lateral projections 85 which are adapted to be received within notches 24 of the shoe 20. The forward ends of levers 82, 84 extend forwardly beyond the body 84 and are biased away from each other by means of a spring 80 within body 64.

Body 64 further includes substantially horizontal, inwardly projecting passageways 96 within which there is mounted a ball and spring assemblies 78. The spring loaded ball assemblies 78 extend into the passageway 90 and bears against the shoe 20.

The lateral position of body 64 relative to base plate 28 may be adjusted by means of a thumbwheel 68 which is confined for rotational movement within a generally circular depression 74 in plate 28 beneath body 64. Thumbwheel 68 is provided with an upwardly projecting connector pin 70 which is offset from the rotational axis of thumbwheel 68 and is received within an aperture 71 in the bottom of body 64. Since pin 70 is offset from the rotational axis of thumbwheel 68, it may be appreciated that rotation of thumbwheel 68 produces transverse movement of pin 70, which movement is translated to body 64 thus causing body 64 to move laterally in accordance with the degree of rotation of thumbwheel 68. The periphery of thumbwheel 68 includes teeth similar to thumbwheel 50 and spring and ball assembly 72 received within a passageway in base plate 28 is loaded onto the periphery of thumbwheel 68, thus forming a spring loaded detent which facilitates graduated, controlled rotation of thumbwheel 68.

The rear portion of base plate 28 is biased downwardly away from shoe 20 such that the gibs 66 bear against the corresponding ways in base plate 28, by means of a slide member 76 which is loaded by a spring 77 within a vertical passageway in body 64. The bottom of spring 77 bears against the upper face of thumbwheel 68 while the upper face of slide member 76 extends slightly into the slot 97 and engages the bottom face of shoe 20. Effectively then, spring 77 biases the rear of base plate 28 downwardly away from shoe 20 thereby eliminating vertical movement of the rear of the laser 10 due to "play" between the components of the rear mount 32.

Turning now to the operation of the quick release mount, the laser 10 is installed on the barrel 14 by first sliding the barrel 14 through the slot 42 in mounting ring 40 and then sliding the entire assembly forward until the shoulder 41 of ring 40 engages the flame arrester 16. At this point the spring 54 biases the slide member 38 forwardly into engagement with pin 36. The biasing influence of spring 54 is overcome by continued forward movement of base plate 28, such that slide member 38 slides rearwardly to an intermediate position of displacement within slot 34.

Base plate 28 is displaced forwardly a sufficient distance to permit clearance between the shoe 20 and rear mount 32, and particularly between the end face 92 and end wall 94. With the shoulders 22 aligned with the slots 97 in body 64, the user may allow the force of spring 54 to displace the base plate 28 rearwardly such that the shoulders 22 are slideably received within slots 97, the projection 21 being received within slot 90. The shoulders 22 may be provided with beveled surfaces which slideably engage complimentary surfaces on ends of levers 82, 84, thus forcing the hooked projections 85 of levers 82, 84, outwardly; body 64 continues to slide rearwardly until the hooked projections 85 are received within notches 24 and end face 92 engages wall 94. At this point, the laser 10 is securely mounted on the barrel 14. Fore and aft movement of the laser 10 relative to the barrel 14 is prevented by the biasing influence of spring 54 which takes up any longitudinal slack between the mounting components, the fixed points against which spring 54 acts being the flame arrester 16 and stop 94 on bayonet mount 18.

The forward mount 30 provides elevational adjustment of the forward end of laser 10, and thus of the beam 12, by means of the adjustable thumbwheel 50. Turning of thumbwheel 50 displaces screw 44 and ring 40, thus changing the elevation of base plate 28 relative to the mounting ring 40 which remains stationary on barrel 14. The spring 52 and ball 61 provide an audible calibration of the elevational adjustment, with each "click" of the thumbwheel 50 corresponding to a predetermined elevational change in the laser beam 12. It is important that the components of the forward mount 30 remain in proper relationship to each other in spite of manufacturing tolerances therein, even when the laser is removed from the rifle and subsequently remounted. In this manner, the need for resetting or recalibration of the elevational and windage adjustment mechanisms is eliminated. Toward this end, springs 35 as well as spring 46 provide constant vertical loading between the mounting ring 40 and base plate 28, thereby taking up any vertical slack which may exist between these components of the forward mount 30.

Windage adjustment of the laser beam 12 is provided in the rear mount 32. Rotation of thumbwheel 68 produces lateral displacement of the rear end of base plate 28 relative to barrel 14 due to the fact that the connecting pin 70 received within body 64 remains stationary relative to the barrel 14. Again, the spring and ball detent 72 bearing on the periphery of thumbwheel 68 provides an audible measure of adjustment in order to permit presetting the windage adjustment. Vertical displacement of the rear end of base plate 28 relative to the barrel 14, due to spacing between the components of the rear mount 32, is precluded by the spring loading of slide member 76 against shoe 20. As previously indicated, the spring and ball assemblies 78 prevent lateral movement of the body 64 relative to shoe 20.

In order to remove the laser 10 from the barrel 14, the forward ends of levers 82, 84 are pinched together thereby moving the hooked projections 85 into clearing relationship with the shoulders 22. The base plate 28 is then displaced forwardly, against the biasing influence of spring 54, until the body 64 clears the shoe 20, whereupon the aiming device may be removed from the barrel by sliding the barrel 14 through the slot 42 in mounting ring 40.

From the foregoing, it is apparent that the mounting arrangement as described above provides for quick and simple release of the laser from the rifle without the need for tools or special instruments. Moreover, the mount assembly includes windage and elevational adjustment mechanisms which are undisturbed by the mounting and dismounting process, thus eliminating the need for recalibration when the laser is remounted.

Although the quick release mount described herein above has been disclosed in connection with a military type rifle having a flame arrester and bayonet mount thereon, the novel mounting assembly may be employed with various types of rifles simply by providing the outer end of the barrel with an appropriate collar or stop similar to the flame arrester previously described and securing a suitable, downwardly depending shoe from the rifle barrel a suitable distance rearwardly of the forward stop or collar.

In view of the above, it is apparent that the quick release mounting assembly described above not only provides for the reliable accomplishment of the objects of the invention but does so in a particularly effective and efficient manner. It is recognized, of course, that those skilled in the art may make various modifications or additions to the preferred embodiment chosen to illustrate the invention without departing from the spirit and scope of the present contribution of the art. Accordingly, it is to be understood that the protection sought and to be afforded hereby should be deemed to extend to the subject matter claimed and all equivalents thereof fairly within the scope of the invention.

We claim:

1. Apparatus for removably mounting an aiming laser on the barrel of a rifle or the like, comprising:

an elongate base member adapted to extend essentially parallel to the longitudinal axis of the barrel in a position beneath the barrel;

a forward mount including a ring adapted to be slideably received over the barrel, a slide member having said ring secured thereto and means for slideably mounting said slide member on said base for sliding movement between a locked position securing said ring on the barrel and a released position allowing disengagement of said ring from the barrel;

means carried by said slide member for adjusting the elevation of one end of the laser relative to said longitudinal axis;

a rear mount adapted to releaseably connect the barrel with a rear portion of said base; and means connected with said rear mount for adjusting the horizontal alignment between said base and said longitudinal axis.

2. The apparatus of claim 1, wherein said mounting means includes an elongate slot in said base, said slide member being slideably received within said slot.

3. The apparatus of claim 2, wherein said mounting means includes ways on said base along said slot and gibs on said slide member retained within said ways.

4. The apparatus of claim 3, including means for vertically biasing said gibs against said ways.

5. The apparatus of claim 1, including means for biasing said slide member toward said locked position thereof.

6. The apparatus of claim 2, wherein said elevation adjusting means includes a thumbscrew connecting said slide member with said ring.

7. The apparatus of claim 6, wherein said thumbscrew includes a thumbwheel, a screw secured to said thumbwheel and rotatable by said thumbwheel and means for engaging said base and for biasing said base away from said ring.

8. The apparatus of claim 1, wherein said rear mount includes:

a pair of shoulders adapted to be secured to the barrel, a body having a pair of slots therein for respectively receiving said shoulders therein, and means for releaseably holding said shoulders in said slots.

9. The apparatus of claim 1, wherein said rear mount includes a slide body and means for mounting said slide body for transverse sliding movement on said base.

10. The apparatus of claim 9, wherein said means for adjusting said horizontal alignment includes a rotatable thumbwheel captured between said slide body and said base and an eccentric drive coupling said thumbwheel with said slide body.

11. Apparatus for removably mounting an elongate aiming device on the barrel of a rifle, comprising:

an elongate base adapted to have the aiming device secured thereto;

a rear mount adapted to releasably connect a rear portion of said base with the barrel; and a forward mount assembly to releasably connect a forward portion of said base with the barrel and including a ring adapted to slideably encircle the barrel and a longitudinally slideable member carrying said ring and slideable on said forward base portion between a locked position in which said ring coacts with the barrel to secure said forward base portion on the barrel and a released position in which said ring may be disengaged from the barrel to allow disengagement of said forward base portion from the barrel.

12. The apparatus of claim 11, wherein said mounting means includes means for biasing said slideable member to slide toward said locked position thereof.

13. The apparatus of claim 11, wherein said ring is split to allow insertion thereof over the barrel.

14. The apparatus of claim 11, including windage adjustment means for mounting said rear mount for transverse sliding movement on said base, said windage adjustment means including means for adjusting the transverse position of said rear mount relative to said base.

15. The apparatus of claim 11, wherein said rear mount includes a longitudinally extending locking element adapted to be secured to the barrel, a rear mounting body connected to said base and having a longitudinal slot for receiving said locking element therein and means for releaseably holding said locking element in said slot.

16. The apparatus of claim 15, wherein said releaseable holding means includes a pair of locking arms each pivotally mounted on said rear mounting body and including a notch for receiving and holding said locking element therein.

17. The apparatus of claim 11, including means adapted to normally biasing said rear mount away from the barrel to prevent shifting movement of said rear mount relative to the barrel.

18. For use with a rifle of the type including a barrel having an enlarged portion on the outer end thereof and a bayonet mount secured to said barrel and spaced from said outer end, said bayonet mount including a longitudinal projection, apparatus for releaseably mounting a laser on said barrel, comprising:

an elongate base extending essentially parallel to the longitudinal axis of said barrel, said laser being secured to said base;

a slide member mounted on said base for sliding movement longitudinally between locking and released positions;

means secured to said slide member for engaging said enlarged portion of said barrel when said slide member is in said locked position thereof, said engaging means being disengaged from said enlarged portion when said slide member is in said released position thereof; and means carried by said base and spaced rearwardly from said slide member for releaseably connecting said base with said bayonet mount.

19. The apparatus of claim 18, wherein said engaging means includes a split ring member.

20. The apparatus of claim 19, including means for mounting said split ring member on said slide member for elevational movement, whereby to permit elevational adjustment of said laser relative to said longitudinal axis.

21. The apparatus of claim 18, including means for normally biasing said slide member to slide toward said locking position thereof.

22. The apparatus of claim 18, wherein said base includes a longitudinal slot therein and said slide member is slideably confined within said slot.

23. The apparatus of claim 18, wherein said base is suspended beneath said barrel.

24. The apparatus of claim 18, wherein said connecting means includes a body member having a passageway therein for receiving said projection and means on said body member for releaseably holding said projection within said passageway.

25. The apparatus of claim 18, wherein said connecting means includes a body member and there is further provided means for mounting said body member for transverse sliding movement on said base, whereby to permit windage adjustment of said laser relative to said longitudinal axis.

26. Apparatus for releaseably mounting an elongate aiming device on the barrel of a firearm, comprising:

a forward mount including a first portion coupled with said device and a second portion slideably mounted on said first portion and releaseably engaging said barrel; and a rear mount including a first portion coupled with said device, a second portion mounted on said barrel and means for releaseably connecting said first portion with said second portion, said forward mount including means carried by said forward mount for adjusting the elevation of said device relative to said barrel and said rear mount including means for adjusting the windage of said device relative to said barrel.

27. Apparatus for releaseably mounting an elongate aiming device on the barrel of a firearm, comprising:

a forward mount including a first portion coupled with said device and a second portion slideably mounted on said first portion and releasealy engaging said barrel;

a rear mount including a first portion coupled with said device, a second portion mounted on said barrel and means for releaseably connecting said first portion with said second portion; and a base secured to said device, said first portion of said forward mount and said rear mount being shiftably mounted on said base.

28. The apparatus of claim 27, wherein said first portion of said forward mount is mounted on said base for longitudinal sliding movement and said first portion of said rear mount is mounted for transverse sliding movement on said base.

* * * * *